United States Patent [19]

Kruse et al.

[11] Patent Number: 5,040,858

[45] Date of Patent: Aug. 20, 1991

[54] MOUNTING FOR FURNITURE HAVING SUPERIMPOSED DRAWERS

[75] Inventors: Detlev Kruse, Spenge; Volker Pohlmann, Hiddenhausen, both of Fed. Rep. of Germany

[73] Assignee: Paul Hettich GmbH & Co., Kirchlengern, Fed. Rep. of Germany

[21] Appl. No.: 490,673

[22] PCT Filed: Jun. 13, 1989

[86] PCT No.: PCT/DE89/00386

§ 371 Date: Mar. 5, 1990

§ 102(e) Date: Mar. 5, 1990

[87] PCT Pub. No.: WO90/00661

PCT Pub. Date: Jan. 25, 1990

[30] Foreign Application Priority Data

Jul. 5, 1988 [DE] Fed. Rep. of Germany ..... 3822678

[51] Int. Cl.[5] ..... E05C 7/06

[52] U.S. Cl. ..... 312/221

[58] Field of Search ..... 312/216–221

[56] References Cited

U.S. PATENT DOCUMENTS 4,396,239 8/1983 Wissman ..... 312/221 X

FOREIGN PATENT DOCUMENTS 2131548 10/1972 Fed. Rep. of Germany .
2916245 11/1980 Fed. Rep. of Germany .
2388116 11/1978 France .
2514236 4/1983 France .

*Primary Examiner*—Joseph Falk
*Attorney, Agent, or Firm*—Peter K. Kontler

[57] ABSTRACT

An article of furniture has a series of superimposed drawers. An arresting mechanism for the drawers includes an activating device secured to a side wall of the article of furniture adjacent to each drawer. Each activating device comprises a carrier which is affixed to the side wall and supports an entraining element. The entraining elements are rotatable and also shiftable horizontally in the direction of movement of the drawers. Each entraining element defines a gap and each drawer carries an operating pin which is received in the corresponding gap when the drawer is closed. An entraining peg is provided on each entraining element.

The activating devices have aligned passages which receive a vertically movable strip extending by all of the drawers. The strip has an angular groove adjacent to each drawer consisting of a vertical portion and an inclined portion, and each entraining peg projects into a respective groove.

Upon opening a drawer, the operating pin shifts the associated entraining element horizontally while rotating the same. The horizontal displacement of the entraining element causes the respective entraining peg to travel along the inclined portion of the corresponding groove. As the entraining peg travels, it lifts the strip so that the entraining pegs associated with the remaining, stationary drawers enter the vertical portions of the respective grooves. This locks the remaining drawers in their closed positions.

19 Claims, 4 Drawing Sheets

MOUNTING FOR FURNITURE HAVING SUPERIMPOSED DRAWERS

BACKGROUND OF THE INVENTION

The invention relates to a mounting for an article of furniture having superimposed drawers.

In a known mounting of the type under consideration, an operating cam is in the form of a pin is mounted on an arm. The arm is secured to a rail section which can be pulled out with the drawer. The pin cooperates with a rotary slide which is in the form of a forked lever and can be pivoted into two terminal positions by means of a tension spring. When the drawer is pulled out, the forked lever is pivoted in such a manner that, after a relatively short travel, the pin on the arm comes out of engagement with the forked lever. Since the rotary slide is moved beyond the dead point, it remains in this position. When the drawer is pushed in, the pin on the arm comes into contact with the forked lever. As soon as the dead point has been passed, the drawer is pulled into the terminal position by the spring and also held in this position.

This mounting is designed such that all drawers of a file cabinet or desk, for example, can be in the open position at one time. For safety reasons, however, it should be possible to pull out only a single drawer. It is also desired that, in the closed position, the front plate of a drawer lies against the front side of the article of furniture without a gap. The known mounting is further designed such that the drawer cannot be returned to the closed position if, while the drawer is open, the rotary slide is inadvertently manually pivoted to the position corresponding to the closed position of the drawer.

SUMMARY OF THE INVENTION

It is an object of the invention to develop a mounting which allows only one of a plurality of drawers to be pulled out at one time. During closing, each drawer is to be pulled into the closed position over a relatively short distance and is to be held in this position. Each drawer is to be brought into the closed position even in case of improper operation, and rebounding of the closed drawer when this is pushed in with excessive speed or force is to be prevented.

According to the invention, the rotary slide functions not only to bring the retracted drawer into the closed position through the final, relatively short section of its path and to hold it in this position but, in cooperation with a blocking strip, to prevent extension of the remaining drawers when such drawer is pulled out. This becomes possible because the rotary slide is also displaceable in the direction of movement of the drawer in particularly simple fashion. By means of a peg which is affixed to the rotary slide and projects into the inclined part of the angular groove of the blocking strip, the horizontal movement of the rotary slide is converted into a vertical displacement of the blocking strip since the peg slides within the groove and, depending upon the direction of movement of the rotary slide, lifts or lowers the blocking strip. The rotary slide is accordingly to be considered as a drive member for the blocking strip. By virtue of the dual function, a particularly simple structural design is achieved.

The mounting under consideration is designated in the art as a self-retracting mounting. A resilient return is achieved not only by means of the spring-loaded rotary slide but also due to cooperation of the rotary strip with the blocking strip. As a result, a braking member is obtained.

In accordance with one embodiment of the invention, the operating cam, which is moved along synchronously during extraction of the drawer, initially abuts the free edge of the resilient arm thereby drawing along the rotary slide and simultaneously rotating it to such an extent over a section of its path that the operating cam is disengaged from the rotary slide. The rotary slide normally remains in this position. Upon retraction, the operating cam travels up an abutment cam of the rotary slide so that the rotary slide is moved back to the starting position counter to its previous motion with simultaneous rotation in the opposite direction. However, if the rotary slide is manually brought into the position corresponding to the closed position of the drawer while the drawer is open, the operating cam travels up resilient arm of the rotary slide so that this arm is deflected in a direction towards the blocking strip. The operating cam can then enter the intermediate space bounded by the abutment cam and the resilient arm.

According to another embodiment of the invention, the rotary slide remains in its angular position when the drawer is open. This eliminates the need to pass through a dead point which requires an unfavorable increase in the spring force.

In accordance with a further embodiment of the invention, only a single part is required for guidance of the blocking strip and movable mounting of the rotary slide. This simplifies installation. Moreover, only one tool is necessary when this part, which can be in the form of a contoured body, is an injection molded part of synthetic resin. Furthermore, this contoured body allows an article of furniture to be retrofitted with the mounting in particularly simple fashion since the contoured body can be screwed to the furniture frame. The furniture frame itself requires no additional guides for the blocking strip.

BRIEF DESCRIPTION OF THE DRAWINGS

Other advantages and features of the will be forthcoming from the following description of a preferred embodiment with reference to the accompanying drawings where FIG. 1 is a front view of the mounting with the drawer pushed in.

DESCRIPTION OF THE PREFERRED EMBODIMENTS

Figure 5:
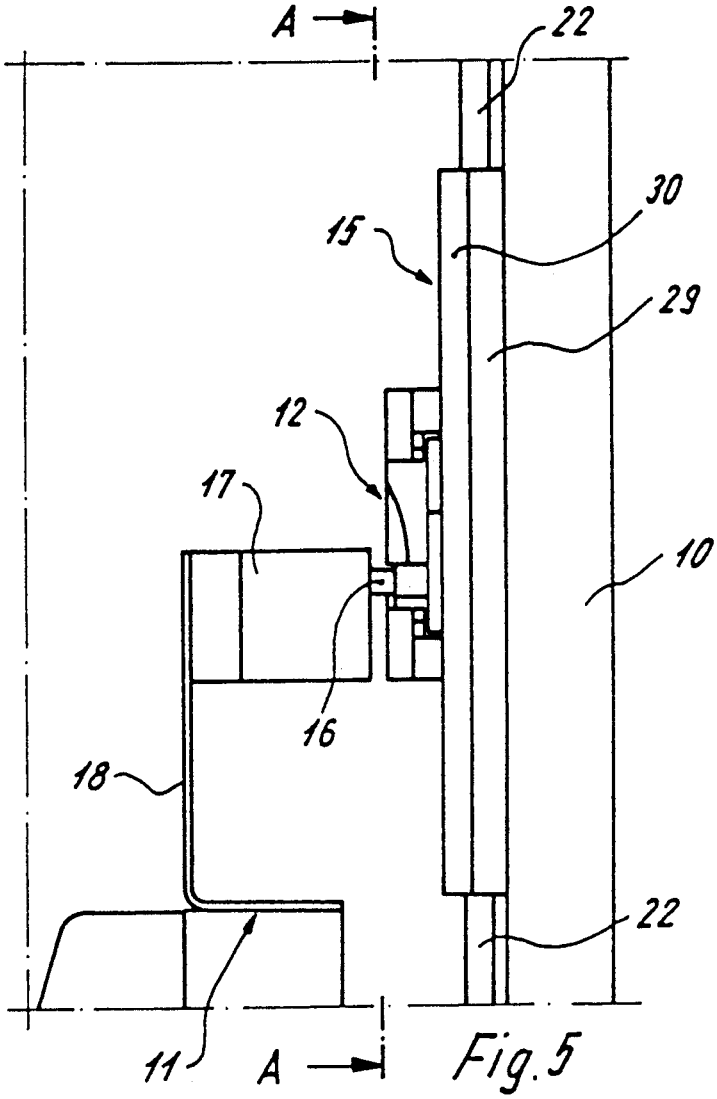
FIG. 5 is a side view of the mounting.

The mounting illustrated in the Figures is screwed to the inner surface of a side wall 10 of an article of furniture as close as possible to the front side. A drawer 11 is shown in FIG. 5 by way of example and a mounting is required for each such drawer. It is sufficient if the mounting is provided at one side. As seen in FIG. 5, it lies above the drawer 11. This arrangement presents itself since the front plate of a drawer normally has a height greater than that of the actual drawer.

The mounting includes a rotary slide 12 which, on the side facing away from the furniture frame, has a suspension pin 13 for a tension spring 14. The other end of the tension spring 14 is suspended from a pin of a contoured body 15 still to be described. The tension spring 14 is prestressed. In the closed position of the drawer 11, the rotary slide 12 is in contact with an operating cam 16 affixed to the drawer 11. As illustrated in FIG. 5, the operating cam 16 is formed on a block 17 which is secured to a bent leg of the side wall of the drawer 11 by means of a fastening bracket 18.

Figure 6:
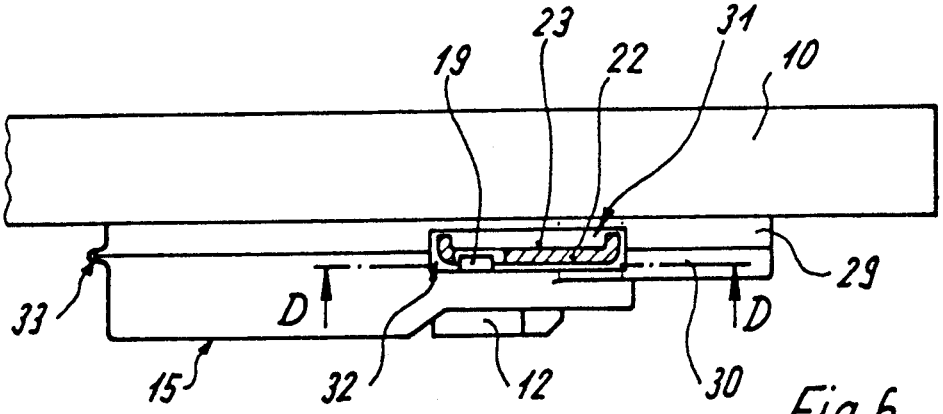
FIG. 6 is a plan view of the mounting.
Figure 7:
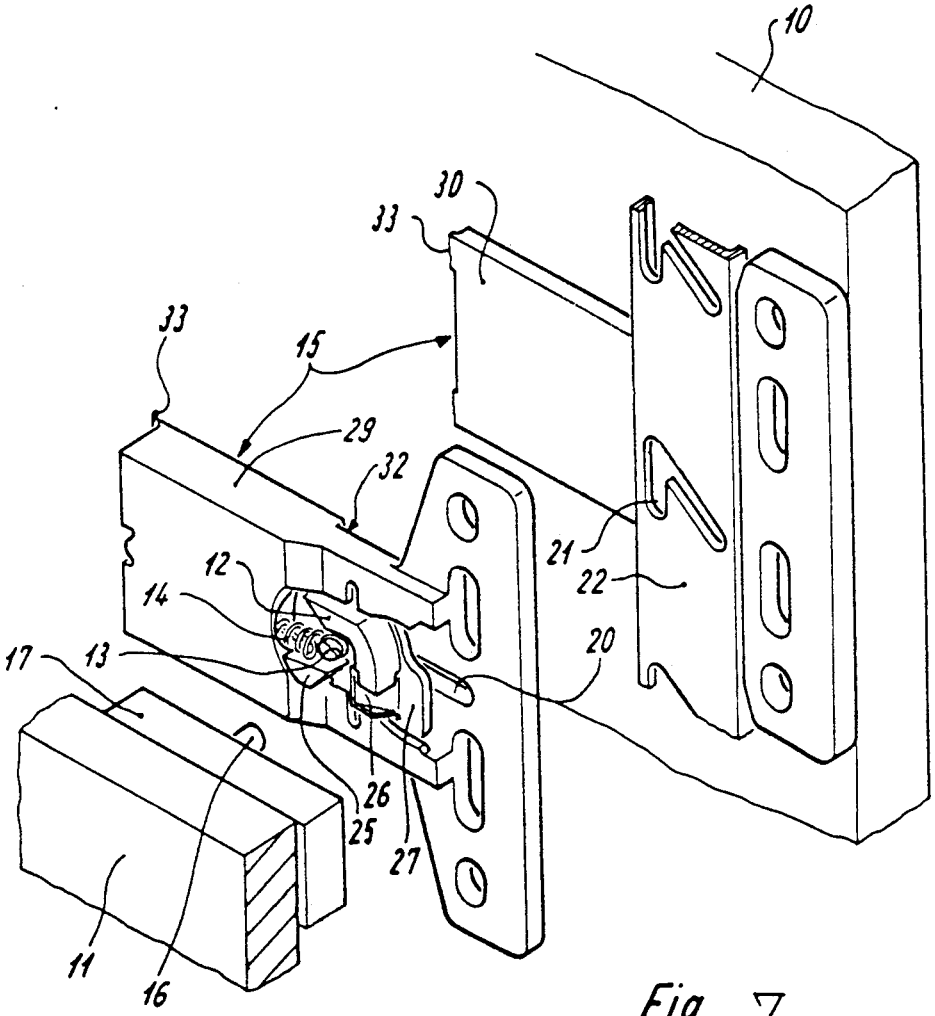
FIG. 7 is a partly broken away, partly sectional exploded view of the mounting.

An entraining peg 19 is affixed to the side of the rotary slide 12 facing the side wall 10 of the furniture frame and the central longitudinal axis thereof registers with the central longitudinal axis of the suspension pin 13 for the tension spring 14. These central longitudinal axes define the axis of rotation of the rotary slide 12. The entraining peg 19 projects through a horizontal guide groove 20 provided in the contoured body 15. The length of the entraining peg 19 is so great that the free end passes through the guide groove and penetrates an angular groove 21 of a blocking strip 22. FIG. 6 shows that the blocking strip 22 is movably guided in a guide channel 23. The length of the guide groove 20 and the width of the blocking strip 22 are essentially equal. The guide groove 20 opens to the guide channel 23. The blocking strip has at least as many angular grooves 21 as the article of furniture has drawers 11. However, additional angular grooves are provided in the fragmentary views of FIGS. 3 and 4 in order that the same blocking strips 22 may be used for drawers of different height. As still to be explained, only the upper and lower annular grooves 21 are used in the fragmentary views.

Figure 1:
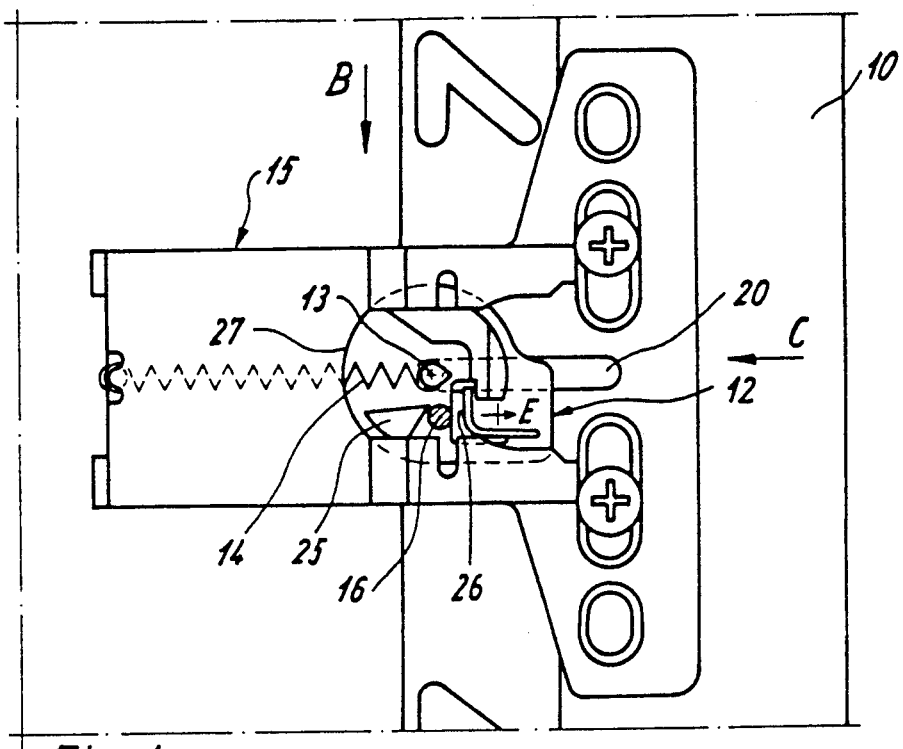
Figure 2:
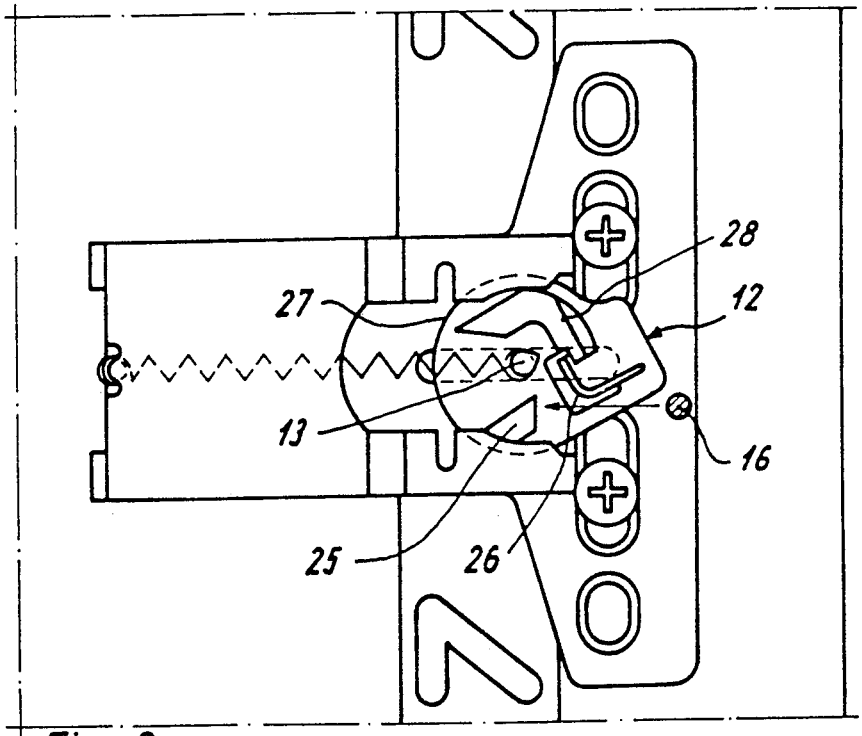
FIG. 2 is an illustration corresponding to FIG. 1 but with the drawer pulled out.
Figure 3:
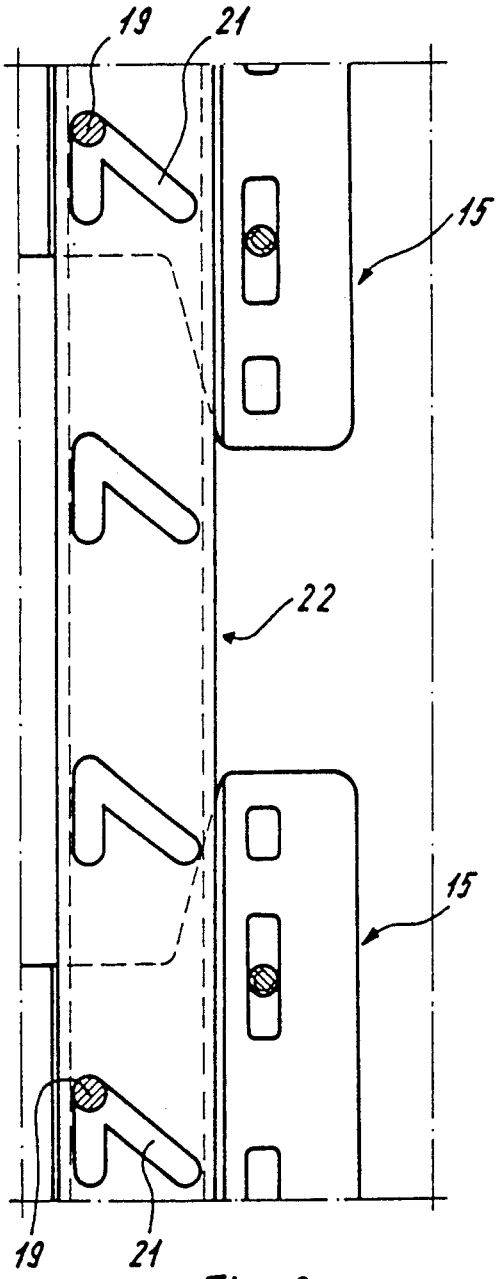
FIG. 3 is a fragmentary, partly sectional rear view of the blocking strip in the position of the rotary slide or the drawer as in FIG. 1.
Figure 4:
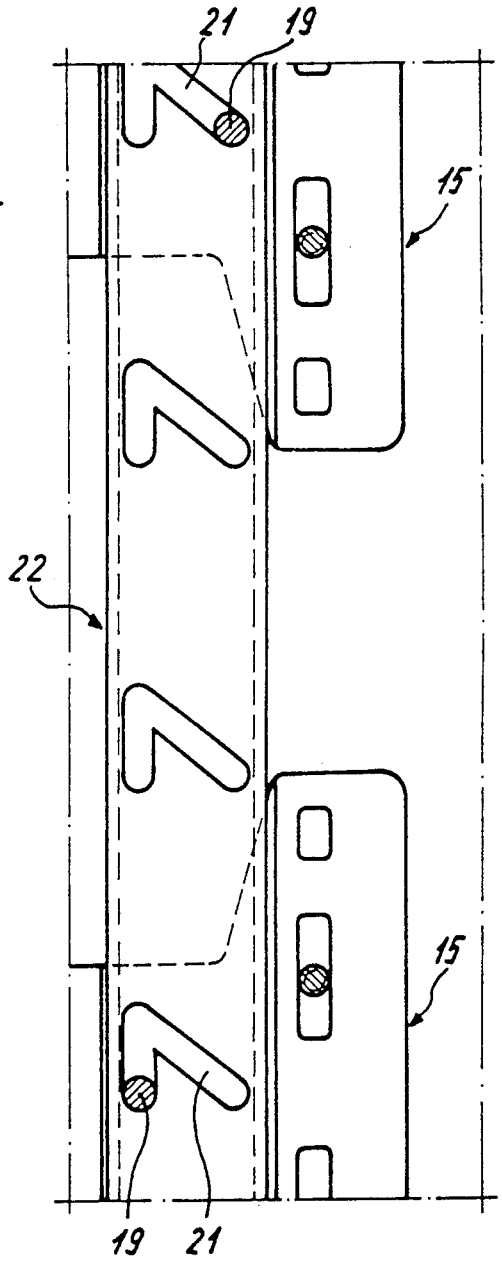
FIG. 4 is a fragmentary, partly sectional rear view of the blocking strip, in the position of the rotary slide or the drawer as in FIG. 2.

On the side facing away from the side wall 10, the rotary slide 12 has an abutment cam 25 offset with respect to the axis of rotation thereof and a resilient arm 26 disposed at an acute angle to the plane of movement of the rotary slide 12. In the closed position of the drawer 11 illustrated in FIG. 1, the resilient arm 26 lies at the same level as the abutment cam 25. The distance between the confronting surfaces of the abutment cam 25 and the resilient arm 26 is so great that the operating cam 16 can penetrate into the space bounded thereby. When the drawer 11 is pulled out of the article of furniture, the operating cam 16 moves synchronously in the direction of the arrow E. As a result, the rotary slide undergoes synchronous linear movement and, per the illustrations of FIGS. 1 and 2, simultaneous rotation in a counterclockwise direction. At a predetermined angular position of the rotary slide 12, the operating cam 16 travels out of the space bounded by the abutment cam 25 and the resilient arm 26. FIG. 3 shows the position of the entraining peg 19 of two superimposed drawers 11 in the closed position. By virtue of the linear movement of the rotary slide 12 due to outward travel of the upper drawer 11, the corresponding entraining peg 19 lifts the blocking strip 22. The angular grooves 21 consist of a vertical portion and an inclined portion which makes an acute angle therewith. The vertical portion lies near the longitudinal side facing away from the front side of the article of furniture. The inclined portion extends essentially over the entire width of the blocking strip 22. When all of the drawers 11 are in the closed position, all entraining pegs 19 of the rotary slides 12 are located at the intersection of the two portions. If one of the drawers 11, the upper drawer in the illustrated embodiment, is pulled out, the blocking strip 22 in the present embodiment is moved upwards.

Consequently, the entraining pegs 19 of the remaining rotary slides 12 enter the vertical portions of the angular grooves 21. It is seen from FIG. 4 that the lower drawer 11 can then no longer be moved out of the closed position.

The rotary slide 12 has a guide plate 27 on which the abutment cam 25 and the resilient arm 26 are formed. The guide plate 27 is guided in two vertically superimposed slots of the contoured body 15. The basic outline of the guide plate 27 is circular to permit rotation. However, for better guidance in the slots, the side thereof facing the front side of the article of furniture has two guide surfaces at right angles to one another. An arresting and guiding bracket 28 is formed on the guide plate 27 and has a sliding surface parallel to the lower guide surface of the guide plate 27. In this man the rotary slide 12 is satisfactorily guided during the linear motion. The outer webs bounding the slots for the guide plate 27 are constructed as circular arcs in the area facing the front side of the article of furniture. With reference to the position of the rotary slide 12 for an open drawer 11 as shown in FIG. 2, the center point coincides with the central longitudinal axis of the entraining peg 19 of the rotary slide 12. The circular arcs cooperate with the abutment cam 25 and the arresting and guiding bracket 28 in such a fashion that the rotary slide 12 remains in the position illustrated in FIG. 2 until the operating cam 16 contacts the outer surface of the abutment cam 25.

As can be seen particularly in FIGS. 1 to 4, the contoured body 15 is T-shaped. It can be observed from FIGS. 5 and 6 that it consists of two parts 29,30 having essentially the same basic outline. Simpler installation is achieved in this manner. The parts 29,30 have respective grooves 31,32 which, in assembled condition, form the guide channel 23 for the blocking strip 22. At the side facing away from the front of the article of furniture, the parts are connected to one another via a cassette hinge 33 so that, after installation of the rotary slide 12 and the tension spring 14, the parts 29,30 can be folded together in order to be screwed to the side wall 10. Due to the hinge-like design, a part 29 or 30 can never be lost.

Except for the tension spring 14 and the blocking strip 22, all components are made from synthetic resin by injection molding. In addition to economy of manufacture, this assures particularly the functioning of the rotary slide 12 since the resilient properties of a synthetic resin as regards shape and material can be exploited.

In the illustrated embodiment, the angular grooves 21 are designed as cutouts.

We claim:

1. A mounting for an article of furniture having an upper drawer and a lower drawer which are disposed one above the other and are movable along a predetermined direction between respective retracted positions and respective extended positions, said mounting comprising an elongated locking member displaceable transverse to said predetermined direction and designed to extend from the upper drawer to the lower drawer, said locking member being provided with an angular slot for each drawer, and each of said slots having a vertex and first and second legs extending from the respective vertex; a shifting member for each drawer movable with the respective drawer; a rotatable and translatable displacing member for each drawer engageable by the respective shifting member so that each displacing member is shifted from a rest position to an operative position in response to movement of the respective drawer from the retracted position to the extended position, each of said displacing members having an entraining protuberance which is designed to project into a respective slot and to be located at the vertex there of in the rest position and in the first leg thereof in the operative position, and each of said displacing members being shiftable between the rest position and the operative position by translation along said predetermined direction and rotation about the respective protuberance, the first and second legs of each slot defining an angle such that movement of one drawer from the retracted position to the extended position causes the associated protuberance to travel along the first leg of the respective slot while bearing against said locking member so that the latter is displaced and the other of said protuberances is received and arrested by the second leg of the associated slot thereby locking the other drawer in the retracted position; and a biasing member for each of said displacing members to urge the respective displacing member into the rest position.

2. The mounting of claim 1, wherein each of said displacing members has a side adapted to face the respective drawer, each of said sides being provided with an abutment and an arm spaced from the respective abutment so as to define a gap which receives the associated shifting member in the retracted position of the respective drawer.

3. The mounting of claim 2, wherein each of said arms is disposed in front of the respective abutment, said arms being resilient and inclined to the respective sides in such a manner that, upon movement of a drawer from the extended position to the retracted position when the respective displacing member is in the rest position, the associated shifting member can deflect the respective arm so as to enter the respective gap and thereby permit arrival of the drawer at the retracted position.

4. The mounting of claim 2, wherein each of said abutments comprises means for arresting the respective displacing member in the operative position.

5. The mounting of claim 1, further comprising a support for each of said displacing members, each of said supports having means for securing the same to the article of furniture, and each of said supports being provided with a guide channel for said locking member.

6. The mounting of claim 5, wherein each of said supports comprises a contoured member.

7. The mounting of claim 5, wherein each of said supports is provided with a pair of registering guide passages and each of said displacing members comprises a plate which is guided in the respective passages, said protuberances being mounted on said plates.

8. The mounting of claim 7, wherein each of said plates has a side which is adapted to face the respective drawer, each of said sides being provided with a protrusion which registers with the respective protuberance and engages the respective biasing member.

9. The mounting of claim 8, wherein each of said biasing members comprises a tension spring.

10. The mounting of claim 7, wherein each of said plates has a side which is adapted to face the respective drawer, each of said sides being provided with an arresting and guiding element to guide the respective displacing member and arrest the same in the operative position thereof.

11. The mounting of claim 10, wherein each of said sides is further provided with an abutment and an arm spaced from the respective abutment so as to define a gap which receives the associated shifting member in the retracted position of the respective drawer, each of said supports comprising wall means defining the respective guide passages, and each of said wall means being provided with a cutout having at least one substantially circular arc which cooperates with said abutment and said arresting and guiding element to arrest the respective displacing member in the operative position thereof.

12. The mounting of claim 5, wherein each of said supports is substantially T-shaped.

13. The mounting of claim 5, wherein each of said supports comprises a pair of abutting, substantially mirror symmetrical parts and a hinge connecting the respective parts to one another, each of said parts being provided with at least one groove, and the grooves of abutting parts cooperating to define the respective guide channels.

14. The mounting of claim 13, wherein said hinges are cassette hinges.

15. The mounting of claim 1, wherein said locking member has opposed first and second longitudinal marginal portions and said first marginal portion is arranged to be disposed in front of said second marginal portion, the second leg of each slot extending longitudinally of said locking member at said second marginal portion, and the first leg of each slot being inclined relative to the respective second leg and extending transversely of said marginal portions over substantially the entire width of said locking member.

16. The mounting of claim 1, wherein the first and second legs of each slot make an angle of approximately 45 degrees with one another.

17. The mounting of claim 1, further comprising a bracket for each of said shifting members designed to carry the respective shifting member, each of said brackets having means for securing the same to the respective drawer.

18. The mounting of claim 1, further comprising a support for each of said displacing members, each of said supports including a contoured body having means for securing the same to the article of furniture, a guide channel for said locking member, and a pair of registering guide passages, each of said displacing members comprising a plate which is guided in the respective passages and has at least one guide surface, and said protuberances being mounted on said plates, each of said plates having a side which is adapted to face the respective drawer, and each of said sides being provided with a protrusion which registers with the respective protuberance and engages the respective biasing member, and an arresting and guiding element to guide the respective displacing member and arrest the same in the operative position thereof, each of said biasing members including a tension spring.

19. The mounting of claim 18, wherein each of said sides is further provided with an abutment and an arm spaced from the respective abutment so as to define a gap which receives the associated shifting member in the retracted position of the respective drawer, each of said contoured bodies comprising wall means defining the respective guide passages, and each of said wall means being provided with a cutout having at least one substantially circular arc which cooperates with said abutment and said arresting and guiding element to arrest the respective displacing member in the operative position thereof.

* * * * *